United States Patent [19]

Oh

[11] Patent Number: 4,997,381

[45] Date of Patent: Mar. 5, 1991

[54] DUAL FUNCTIONAL, ELECTRICAL PLUG USE IN CONJUNCTION WITH AN ELECTRIC APPLIANCE

[76] Inventor: Tae J. Oh, 91 Donong-Ri, Mikum-Eup, Namyangju-Kun, Kyungki-Do, Rep. of Korea

[21] Appl. No.: 484,534

[22] Filed: Feb. 26, 1990

[51] Int. Cl.[5] ..... H01R 29/00

[52] U.S. Cl. ..... 439/172; 439/131; 439/174

[58] Field of Search ..... 439/131, 166, 170, 171, 439/172, 173, 174, 175, 221

[56] References Cited

U.S. PATENT DOCUMENTS

| | | | |
|---|---|---|---|
| 1,386,884 | 8/1921 | McKay | 439/131 |
| 2,957,156 | 10/1960 | Gatto et al. | 439/166 |
| 4,013,330 | 3/1977 | Hugly | 439/172 |
| 4,101,757 | 7/1978 | Van Dyck et al. | 439/131 X |

FOREIGN PATENT DOCUMENTS

| | | | |
|---|---|---|---|
| 1109756 | 6/1961 | Fed. Rep. of Germany | 439/173 |

*Primary Examiner*—Neil Abrams
*Assistant Examiner*—Khiem Nguyen
*Attorney, Agent, or Firm*—Birch, Stewart, Kolasch & Birch

[57] ABSTRACT

A dual functional, electrical plug use in connection with an electric appliance which includes a plug receiving member having a pair of cylindically shaped grooves and attached to the electric appliance, a casing member adapted to receive the plug receiving member, a first plug member having a pair of cylindrical shaped electrical pin member and a pair of rectangular shaped grooves and rotatably mounted to the plug receiving member, and a second plug member having a pair of rectangular shaped electrical pin member and rotatably mounted to the first plug member, whereby the first and second plug members form a composite structure enabling the selective use of either the first plug member or the second plug member depending upon high voltage usage or low voltage usage.

7 Claims, 3 Drawing Sheets

DUAL FUNCTIONAL, ELECTRICAL PLUG USE IN CONJUNCTION WITH AN ELECTRIC APPLIANCE

BACKGROUND OF THE INVENTION

1. Field of the Invention

The present invention relates to a dual functional, electrical plug use in conjunction with an electric appliance and more particularly, to an electric plug including a first plug member and a second plug member for forming a composite structure and enabling the selective use of either the first plug member or the second plug member depending upon high voltage usage or low voltage usage.

2. Description of the Prior Art

Various types of electric plugs for use in dual voltages are well known in the art. Such electric plugs include a voltage converting device or a pair of plugs disposed therein. However, such electric plugs suffer from a number of problems such as, for example, the voltage converting device is frequently out of order; when one of pair of plugs is an inoperative position, the other of them has to mask so that it is inconvenient for operation thereof; and it is dangerous since it often occurs the accidental interference between the plugs.

SUMMARY OF THE INVENTION

Accordingly, it is an object of the present invention to provide an improved electrical plug use in conjunction with an electric appliance for overcoming the above problems of the conventional plugs.

Another object of the present invention is to provide a dual functional, electrical plug which includes a first plug member and a second plug member for forming a composite structure and enabling the selective use of either the first plug member or the second plug member depending upon high voltage usage or low voltage usage.

A further object of the present invention is to provide a dual functional, electrical plug for use in an electric appliance which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a dual functional, electrical plug use in connection with an electric appliance which includes a plug receiving member having a pair of cylindrically shaped grooves and attached to the electric appliance, a casing member adapted to receive the plug receiving member, a first plug member having a pair of cylindrical shaped electrical pin member and a pair of rectangular shaped grooves and rotatably mounted to the plug receiving member, and a second plug member having a pair of rectangular shaped electrical pin member and rotatably mounted to the first plug member, whereby the first and second plug members form a composite structure enabling the selective use of either the first plug member or the second plug member depending upon high voltage usage or low voltage usage.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
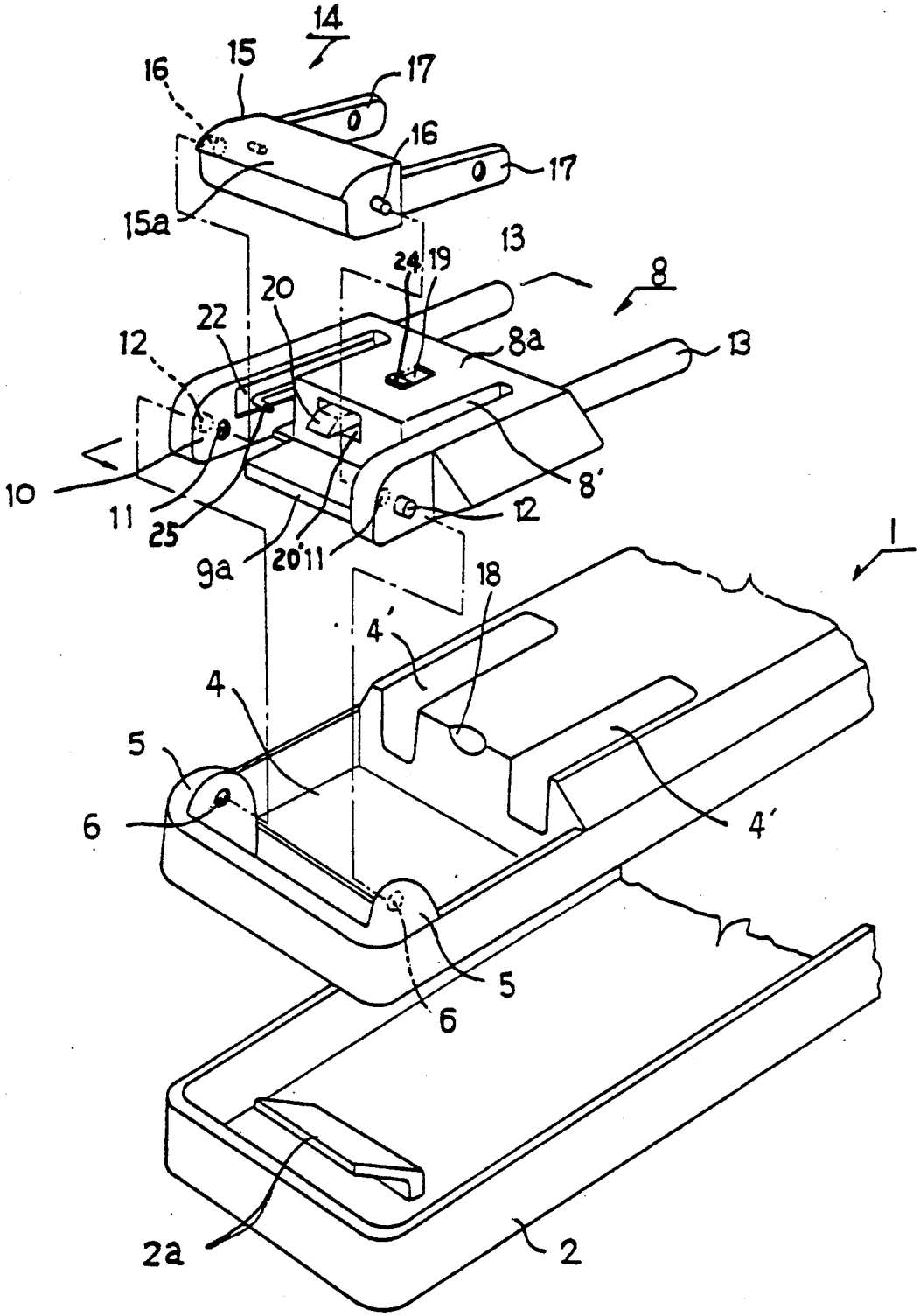
FIG. 1 is an exploded perspective view of a dual functional, electrical plug having first and second plug member as a composite structure according to the present invention.

Referring now in detail to the drawings for the purpose of illustrating preferred embodiments of the present invention, the dual functional, electrical plug for use in an electric appliance as shown in FIG. 1 comprises a plug receiving member 1' attached to the appliance 1 for receiving the electrical plug which includes a first plug member 8 and a second plug member 14 for forming a composite structure, and a casing member 2 for receiving the plug receiving member 1'.

The plug receiving member 1 includes a pair of cylindrically shaped grooves 4' disposed in one side thereof, a first hollow portion 4 disposed in another side thereof, and a pair of flanges 5 disposed on a pair of corners of the other side thereof. Each flange 5 is provided with a first aperture 6. A finger slot 18 is disposed between the pair of cylindrically shaped grooves 4'. The casing member 2 is provided with a first tensible stopper 2*a* disposed on one side portion thereof for positioning within the first hollow portion 4 of the plug receiving member 1'.

Figure 4:
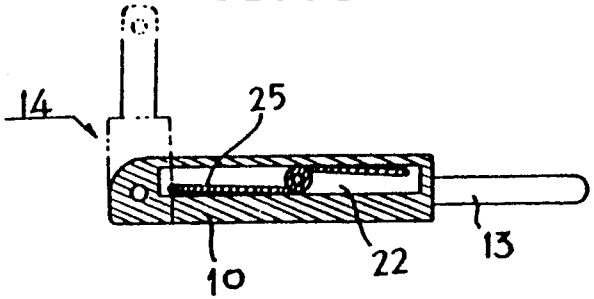
FIG. 4 is a cross-sectional view of an L-shaped spring of the second plug member according to the present invention.

The first plug member 8 defines a first plug body 8*a* having a pair of cylindrically shaped pin members 13 for slidably inserting into the pair of cylindrically shaped grooves 4' of the plug receiving member 1'. The first plug body 8*a* which slidably inserts into the first hollow portion 4 of the plug receiving member 1', includes a pair of rectangular shaped grooves 8' disposed in one side thereof and a second hollow portion 9 disposed in the other side thereof. The second hollow portion 9 of the first plug member 8 contains a pair of first pivotal pins 12 disposed on the outsides of the other side ends thereof for slidably engaging in the pair of first apertures 6 when the first plug body 8*a* is slidably engaged in the first hollow portion 4 of the plug receiving member 1' so as to pivotably rotate the first plug member 8 about the pair of flanges 5 of the plug receiving member 1'. The second hollow portion 9 further contains a pair of second apertures 11 disposed on the insides of the other side ends thereof and in the vicinity of first pivotal pins 12, a plate clamp 9*a*, a push button 24 having a slider 20 and a coil spring 21 (FIGS. 2A and 2B) which is slidably inserted into a hole 20' disposed in the round pin plug body 8a, and an L-shaped spring 25 disposed in a containing groove 22 disposed in one side wall of one rectangular shaped groove 8' for retaining the second plug member 14 (FIG. 4).

Figure 2B:
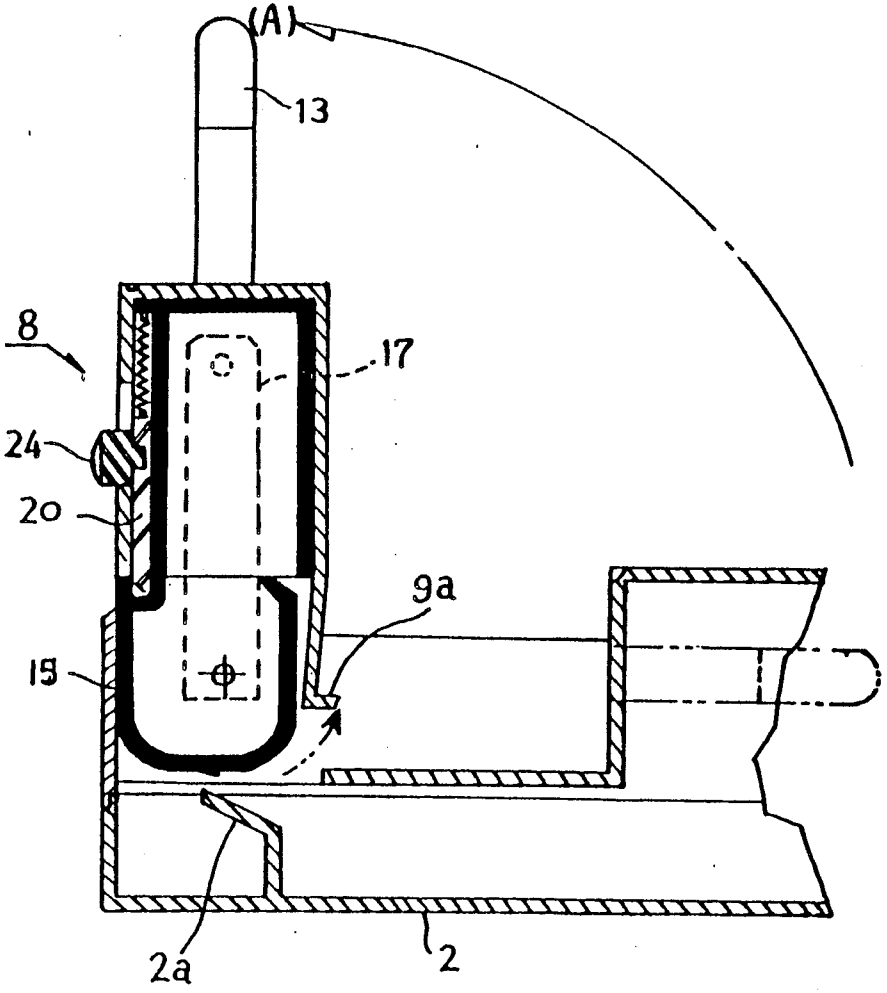
FIG. 2B is a sectional view of the first plug member in its open position.
Figure 2A:
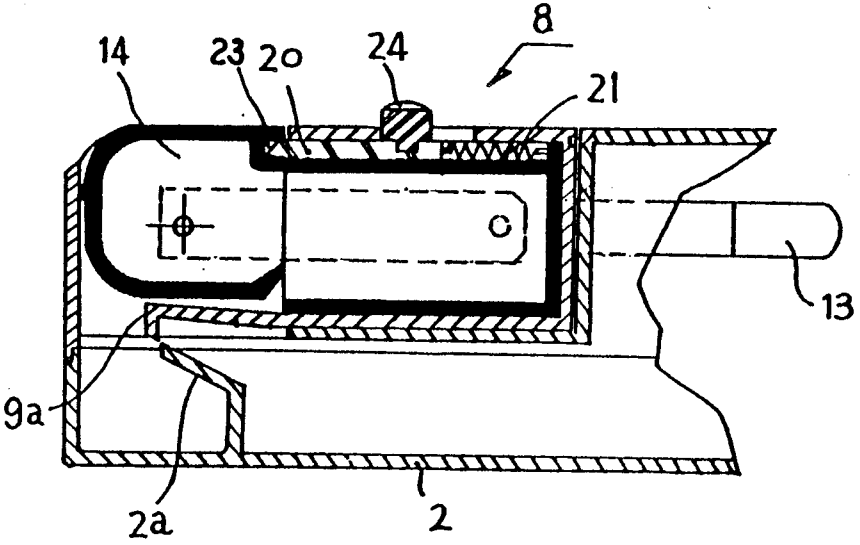
FIG. 2A is a sectional view of the first plug member in its close position.
Figure 3B:
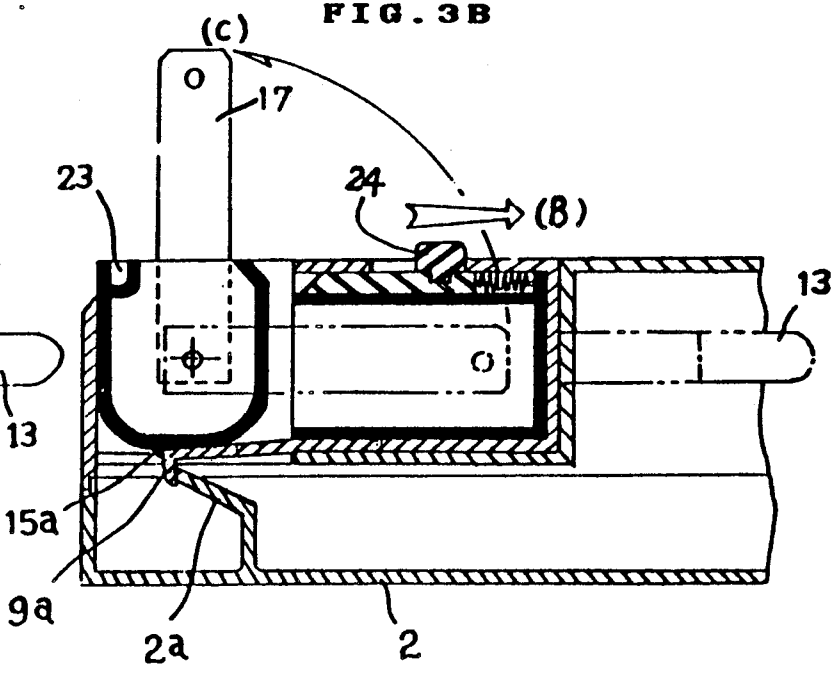
FIG. 3B is a sectional view of the second plug member in its open position.
Figure 3A:
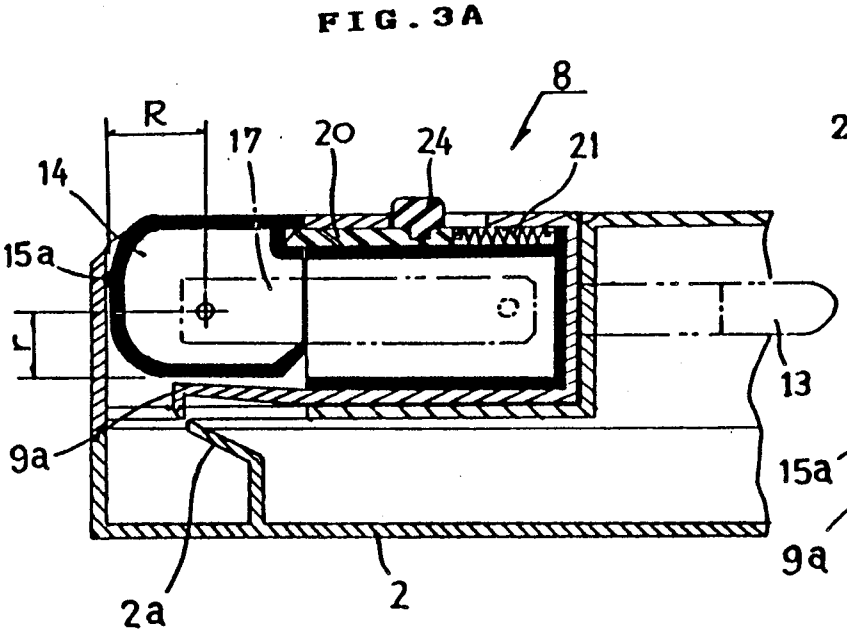
FIG. 3A is a sectional view of the second plug member in its close position.

As shown in FIGS. 1, 3A, and 3B, the second plug member 14 includes a second plug body 15 having a pair of second pivotal pins 16 for slidably engaging in the pair of second apertures 11 when the second plug body 15 is slidably engaged in the second hollow portion 9 of the first plug body 8a so as to pivotably rotate the second plug member 14 about the pair of one ends of the first plug member 8 and a pair of rectangular shaped electrical pin members 17 extending from the second plug body 15 for slidably inserting into the pair of rectangular shaped grooves 8' of the first plug member 8. The second plug body 15 has a bucket configuration and includes an engagement 23 for tightly receiving the slider 20 when the push button 24 pushes downwardly and the slider 20 slidably moves downwardly along the hole 20' as shown in FIGS. 2A, 2B, and 3A, and a projecting member 15a is disposed on the bottom thereof for stopping to the plate clamp 9a of the second plug member 8.

As shown in FIG. 3A, a distance (R) from an end center of the rectangular shaped electrical pin member 17 to the bottom of the second plug body 15 is longer than a distance (n) from the end center of rectangular shaped electrical pin member 17 to one side surface thereof in opposite of the engagement 23. The dual functional, electrical plug for use in the electric appliance 1 according to the present invention operates as follows:

As shown in FIGS. 2A and 2B, when the push button 24 pushes downwardly, the slider 20 moves downwardly along the hole 20 and tightly engages into the engagement 23 by the resilient force of the biased coil spring 21. Thus the second plug member 14 is built in the first plug member 8 which is built in the plug receiving member 1' of the electric appliance 1. Thereafter, by pulling the first plug member 8 from the plug receiving member 1' through the finger slot 18, the first plug member 8 is rotated in the counterclockwise direction of its open position indicated by an arrow (A) shown in FIG. 2B from its close position shown in FIG. 2A. Thus since the first plug body 8a of the first plug member 8 cannot move due to a wall of the plug receiving member 1' and the first plug member 8 may be made 90° about the plug receiving member 1', the first plug member 8 is popped up for readily, electrically connecting to high voltage usage. In turn, after the popped up first plug member 8 is returned to its close position as shown in FIG. 3A, when the push button 24 pushes upwardly, the slider 20 moves upwardly along the hole 20, and is disengaged from the engagement 23 indicated by an arrow (B) shown in FIG. 3A. At this time, the second plug member 14 is rotated in the counterclockwise direction of its open position indicated by an arrow (C) shown in FIG. 3B from its close position shown in FIG. 3A. Thus since the tensible stopper 2a of the casing member 2 tightly holds the plate clamp 9a and the second plug member 14 may be made 90° about the first plug member 8, the second plug member 14 is popped up for readily connecting to lower voltage usage. Accordingly, the dual functional, electrical plug can be used alternately for high voltage usage or low voltage usage.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A dual functional, electrical plug used in conjunction with an electric appliance, which comprises:

a plug receiving member attached to said electric appliance, said plug receiving member containing a pair of cylindrically shaped grooves disposed in one side portion thereof and a first hollow portion disposed in the other side portion thereof, a casing member having a tensible stopper provided at one end thereof, said casing member adapted to receive said plug receiving member with said tensible stopper extending through said first hollow portion, a first plug member rotatably mounted to said plug receiving member, said first plug member containing a pair of rectangular shaped grooves and a pair of cylindrically shaped electrical pin members, said first plug member being rotatable between an inoperative position within said pair of cylindrically shaped grooves of the plug receiving member and an operative position where said pin members are rotatably removed from said grooves, a second plug member rotatably mounted to said first plug member, said second plug member containing a pair of rectangular shaped electrical pin members, said second plug member being rotatable between an inoperative position within said pair of rectangular shaped grooves of the first plug member and an operative position where said pin members are rotatably moved from said grooves, whereby the first and second plug members form a composite structure enabling the selective use of either the first plug member or the second plug member depending upon high voltage or low voltage usage.

2. The dual functional, electrical plug of claim 1, wherein the plug receiving member is provided with a pair of flanges having a first aperture, respectively, said pair of flanges extend from a pair of corner of said first hollow portion of the plug receiving member.

3. The dual functional, electrical plug of claim 1, wherein the first plug member is provided with a first plug body including a pair of pivotal pins disposed on the outside wall thereof for pivotably connecting to said pair of first apertures, a pair of second apertures disposed on the inside wall thereof, and a second hollow portion disposed in one side portion thereof.

4. The dual functional, electrical plug of claim 3, wherein the first plug member is further provided with a push button connecting to a slider and a spring disposed at both ends of said push button which is disposed within said first plug body and a containing groove disposed on the inside wall of one of said rectangular shaped groove for containing an L-shaped spring for holding the second plug member.

5. The dual functional, electrical plug of claim 1, wherein the second plug member is provided with a second plug body having a pair of second pivotal pins for pivotably connecting to the pair of second apertures of the first plug member, a projecting member disposed on the bottom thereof for tightly engaging with the plate clamp of the first plug member so as to hold the second plug member, and an engagement disposed on the top thereof for tightly receiving the slider of the push button.

6. The dual functional, electrical plug of claim 1, wherein the casing member is provided with a tensible stopper for tightly holding the plate clamp of the first plug member when the second plug member is popped up.

7. The dual functional, electrical plug of claim 1, wherein the plug receiving member is provided with a handle slot disposed between said pair of cylindrically shaped grooves for easily pulling the first plug member therethrough.

* * * * *